US005957681A

United States Patent [19]

Hansen

[11] Patent Number: 5,957,681

[45] Date of Patent: Sep. 28, 1999

[54] SELF IGNITED LANDFILL GAS VENT FLARE AND FLAREHEAD

[75] Inventor: David L. Hansen, Averill Park, N.Y.

[73] Assignee: Landfill Technologies, Inc., West Sand Lake, N.Y.

[21] Appl. No.: 08/559,795

[22] Filed: Nov. 15, 1995

[51] Int. Cl.[6] ..... F23D 14/00

[52] U.S. Cl. ..... 431/202; 431/353; 431/354; 431/350

[58] Field of Search ..... 431/202, 266, 431/263, 264, 265, 353, 355, 350, 354, 351, 352, 5; 239/419.5; 60/752

[56] References Cited

U.S. PATENT DOCUMENTS

| | | | |
|---|---|---|---|
| 369,131 | 8/1887 | Smith et al. | 431/352 |
| 878,590 | 2/1908 | York et al. | 431/188 |
| 1,473,716 | 11/1923 | Wilcox | 431/202 |
| 2,461,731 | 2/1949 | Guth | 431/352 |
| 3,756,765 | 9/1973 | Sparrow et al. | 131/202 |
| 4,184,838 | 1/1980 | Burns et al. | 431/202 |
| 4,711,629 | 12/1987 | MacDonald | 431/202 |
| 4,826,427 | 5/1989 | Hyde | 431/202 |
| 4,907,964 | 3/1990 | Howard et al. | 431/202 |
| 4,909,730 | 3/1990 | Roussakis et al. | 431/202 |
| 5,364,262 | 11/1994 | Phillips | 431/202 |
| 5,429,496 | 7/1995 | Stephens et al. | 431/202 |
| 5,472,340 | 12/1995 | Lynch | 431/202 |

*Primary Examiner*—Carl D. Price
*Attorney, Agent, or Firm*—Heslin & Rothenberg, P.C.

[57] ABSTRACT

A landfill gas vent flare is provided which includes a flarehead disposed in communication with a landfill gas vent wherein landfill gas is permitted to flow therethrough. A spark plug is located on the flarehead and is electrically connected to a solar powered ignitor which provides electrical impulses to the spark plug at regular predetermined intervals to generate a spark every 1.5 seconds to ignite the landfill gas and ensure the landfill gas burns continuously. The sparks are continuously generated regardless of the presence of landfill gas or flame in the flarehead. The flarehead comprises an inverted, modified frusto-conical structure and includes a plurality of inlets which permit air to enter the flarehead and mix with the landfill gas to facilitate combustion and to further ensure continuous burning of the gas.

16 Claims, 3 Drawing Sheets

SELF IGNITED LANDFILL GAS VENT FLARE AND FLAREHEAD

BACKGROUND OF THE INVENTION

1. Field of the Invention

This invention relates to means for controlling odors and greenhouse gas emissions from landfills. More particularly, the invention relates to gas flares disposed at capped landfills and adapted to burn landfill gas generated by the decomposition of organic waste.

2. Background Information

As organic waste present in a landfill decomposes, gas commonly known as "landfill gas" is generated. This is a foul smelling gas that generally consists of 55% methane, 44% carbon dioxide and 1% of other various constituents ranging from hydrogen sulfide to complex hydrocarbons. When released directly into the atmosphere, landfill gas may cause severe odor problems. Additionally, methane has been characterized as a "greenhouse" gas which is believed to significantly contribute to global warming.

Currently, once landfills have reached full capacity, they are generally capped with among other things, a layer of topsoil to support vegetation and help prevent erosion. A gas vent, gas well, or other gas collection system is also typically provided to enable the landfill gas generated by the aforementioned decomposition process to conveniently pass through the cap for release.

Because landfill gas burns relatively cleanly, the gas emerging from such a vent, etc. may be burned in an effort to eliminate the aforementioned noxious odor and harmful greenhouse effects. A flare may thus be provided to burn the gas as it emerges from the vent. However, significant disadvantages inhere in this approach which tend to offset the advantages thereof. Particularly, once such a flare has been ignited, it may be difficult to ensure that the flame burns continuously. Several factors contribute to this difficulty, including variations in the flow rate of the gas as a result of environmental conditions such as temperature and ground water levels. Variations in the percentages of the constituents of the landfill gas, namely, methane and CO2, may also affect the optimum gas/air ratio mixture required to maintain a continuous flame. Moreover, adverse weather conditions such as wind and precipitation may tend to extinguish the flame. Because such flares are preferably disposed proximate to the landfill to minimize the use of lengthy gas pipe runs, the flares are usually disposed in remote locations, where it would be difficult to monitor the presence of flame and inconvenient to manually re-ignite the flares in the event the flame is extinguished. Moreover, during any time in which the flame is out, the gas is permitted to escape into the atmosphere, thereby creating potentially lengthy periods in which the odor and greenhouse effects of the landfill are not being treated.

In attempts to remedy this drawback, several devices may be utilized. In particular, vent flares may be provided with electronic ignitors or propane pilot lights. Electronic ignitors generally include sophisticated technology to monitor the presence of flame. In particular, optical or heat sensors may be employed, which, upon detecting an absence of flame, signal electronic circuitry to automatically re-ignite the gas. A drawback of this approach is that such sophisticated equipment is relatively expensive, involving substantial up-front capital expenditure, while also requiring a relatively high degree of routine maintenance.

Propane pilot light systems, on the other hand, help ensure that the landfill gas flame burns continuously by providing a continuously burning pilot light. This type of system has the advantage of being relatively unsophisticated and thus relatively inexpensive to purchase and simple to maintain. A drawback of this approach however, is that the system requires a separate supply of fuel (propane) which must be replaced periodically. In addition, the pilot light itself may be extinguished, by, for example, wind and/or precipitation and thus still require manual re-lighting.

A need therefore exists for an improved landfill gas vent flare that is relatively inexpensive, requires little maintenance, yet serves to reliably maintain a continuous flame under a wide range of operating conditions.

SUMMARY OF THE INVENTION

According to an embodiment of this invention, a landfill gas vent flare includes a flarehead adapted for communication with a landfill gas vent wherein landfill gas is permitted to flow in a downstream direction from the landfill gas vent to the flarehead. A spark initiator is disposed on the flarehead and generates a continuous series of sparks in the flarehead wherein the landfill gas flowing therethrough is ignited and continuously burned.

Advantageously, the continuous series of sparks generated by the subject invention, in a relatively simple and inexpensive manner, serves to ignite the gas flowing through the flarehead and reliably ensure that the gas burns continuously under a wide range of environmental and other operating conditions.

The above and other objects and advantages of this invention will be more readily apparent from a reading of the following description of an exemplary embodiment thereof taken in conjunction with the following drawing.

DETAILED DESCRIPTION OF THE PREFERRED EMBODIMENT

Figure 1:
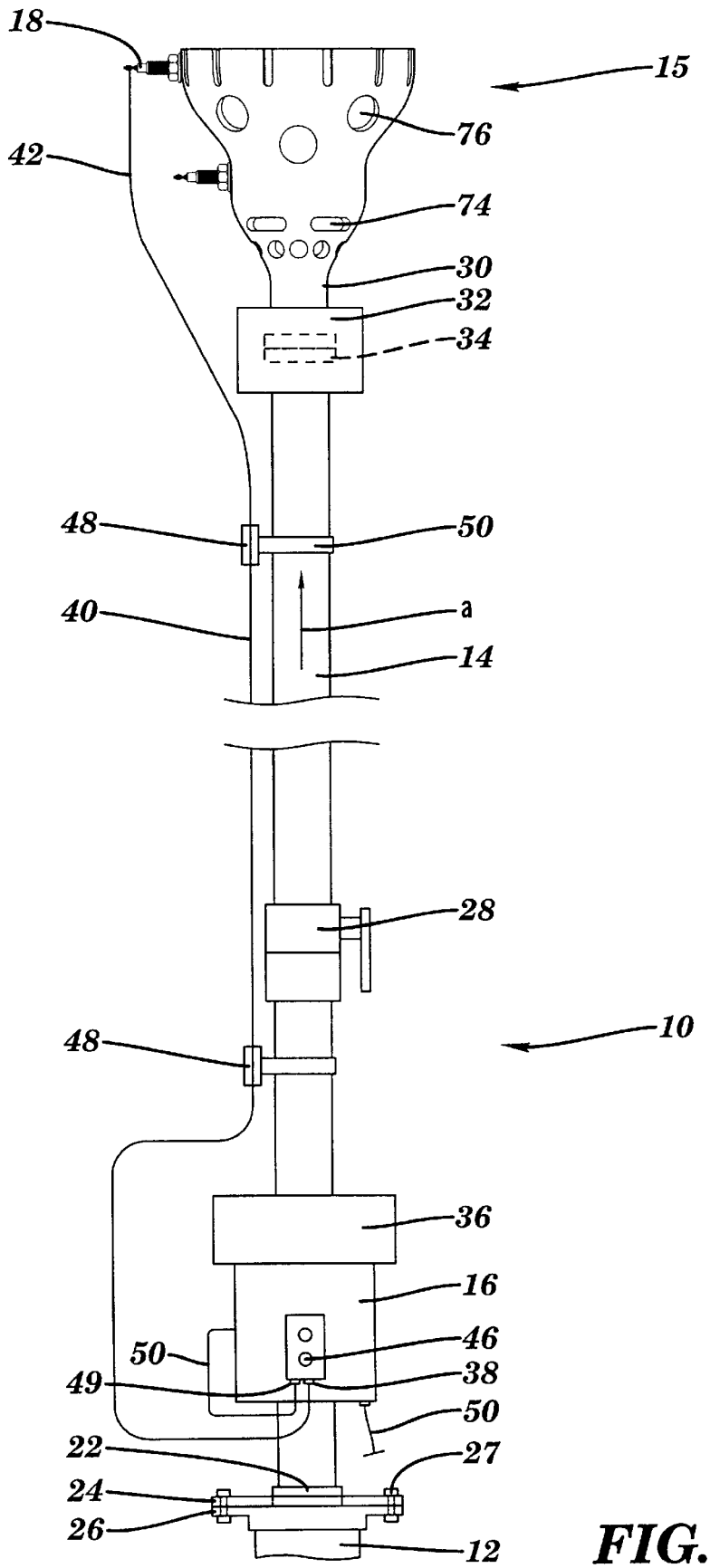
FIG. 1 is schematic elevational front view of the landfill gas vent flare of the subject invention disposed in operative engagement with a landfill gas vent.
Figure 6:
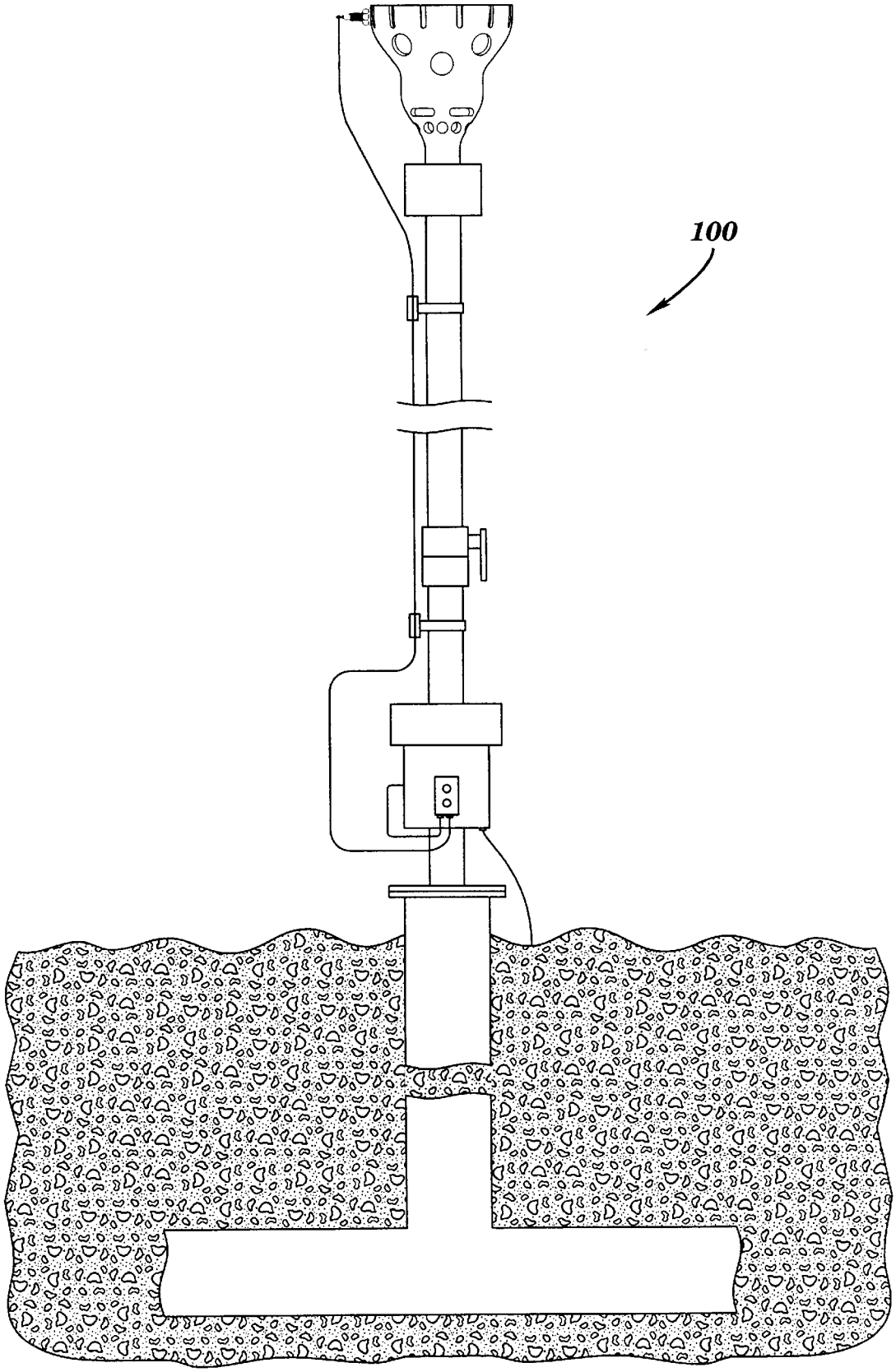
FIG. 6 is a cutaway, partial, side view of a landfill in which the landfill gas vent flare of FIG. 1 is operatively positioned.

Briefly described, as shown in FIG. 1, the subject invention comprises a solar powered landfill gas vent flare 10 which serves to control landfill odors and abate greenhouse gas emissions from a given landfill 100 (FIG. 6) by burning landfill gas as it emerges from a gas vent 12. The gas vent may be connected to a gas well (not shown) or other gas collection system located at a landfill site. The landfill gas vent flare comprises a conduit or gas flow member 14 fastened to vent 12, which serves to permit landfill gas to flow therethrough from the vent to a flarehead 15 where the gas is ignited and burned. Ignition is provided by a solar powered ignitor 16 which supplies a continuous series of high voltage impulses to a spark initiator or spark plug 18 so that a spark is generated in the flarehead every 1.5 seconds.

This continuous sparking helps ensure that the gas in the flarehead is reliably ignited and continuously burned, under a variety of conditions, without the need for expensive flame monitoring equipment or secondary fuel sources. In addition, the flarehead is provided with a geometry and series of inlets, as at 74 & 76, which facilitate mixing of the landfill gas with air to promote combustion and help ensure that the flame will be self sustaining even in adverse weather conditions.

For the purposes of this specification, the term "vent" shall be defined herein as any conduit, pipe or similar member disposed to convey landfill gas from a landfill, including, but not limited to, a pipe comprising a component of a conventional vent, well, or other gas collection system located at a landfill site.

Referring now to FIG. 1 in detail, conduit 14 preferably comprises a metallic pipe and is fastened in an air tight fashion to an exposed end of vent 12 to communicate with and permit the landfill gas to flow therethrough in a downstream direction indicated by arrow a. In a preferred embodiment, such fastening is accomplished in a conventional manner such as by threadably disposing a bushing 22 on one end of the pipe, threadably or otherwise fastening the bushing to a pipe flange 24 and mating the pipe flange to a similar flange 26 disposed on the exposed end of vent 12. Flanges 24 and 26 may conveniently be maintained in mating engagement using threaded fasteners 27 as shown. Both conduit 14 and bushing 24 are preferably fabricated from black iron.

A valve 28, preferably a conventional stainless steel ball valve, is provided at a predetermined point along the length of conduit 14, to permit a user to control the rate of flow of the gas therethrough to vary the size of flame or to shut off the gas flow entirely. A flame arrestor 32 is disposed at a predetermined position along the length of conduit 14, downstream of ball valve 28 and preferably proximate a terminal end 30 of the conduit, as will be discussed hereinafter. The flame arrestor is of a conventional construction, a suitable example being Model #FA-100, manufactured by Landfill Technologies, Inc. of West Sand Lake, N.Y. Briefly described, this device comprises a cylindrical housing with a pair of cylindrical arrestor pads 34 disposed therein. The pads preferably comprise a porous stainless steel wire gauze, similar in construction to a conventional scouring pad and are easily replaceable for routine maintenance, as will be discussed hereinafter. The flame arrestor (as well as pads 34) is disposed concentrically with conduit 14, in blocking relation thereto so that the landfill gas passes through the pads when flowing in the downstream direction. The flame arrestor operates in a conventional manner to prevent ignited gases from "backflashing" upstream of the flame arrestor for safety purposes.

As mentioned hereinabove, the landfill gas is burned once it reaches flarehead 15 disposed at terminal end 30 of the conduit, proximate and downstream of flame arrestor 32. As will be discussed in greater detail hereinafter with regard to FIGS. 2–5, the flarehead is preferably fabricated from a metallic material, such as black iron and includes walls which diverge in the downstream or gas flow direction to provide a modified frusto-conical or bell shaped structure. Air inlets, such as slot 74 and orifices 76, are disposed about the flarehead and will also be discussed in greater detail hereinafter.

As also mentioned briefly hereinabove, ignition of the gas in the flarehead is provided by a solar powered ignitor 16. A preferred ignitor is commercially available and known as a SFI-100 Solar Ignitor available from Landfill Technologies, Inc., of West Sand Lake, N.Y. The ignitor may be disposed at any location proximate the flarehead, while as shown, may preferably be fastened to conduit 14 using conventional fastening means, such as, for example, pipe clamps (not shown).

Briefly described, the ignitor includes a solar collector 36 which charges a battery (not shown), a transformer (not shown) to step up the voltage of the battery output and a time keeping device which sends high voltage impulses to hot line terminal 38 at predetermined intervals. Terminal 38 is electrically connected to spark initiator such as a spark plug 18 disposed on the flarehead by a hot line ignition cable 40 of a predetermined length, in combination with a spark strap 42. The spark strap, which is preferably fabricated from stainless steel, may be uninsulated and fastened to cable 40 using a conventional connector bolt 44. Both cable 40 and strap 42 are preferably fastened to conduit 14 using a conventional combination of insulators 48 and metallic pipe clamps 50.

The ignitor further includes an On/Off switch 46, ground terminal 49 and a ground cable 50 connected to the terminal, conduit 14 and a steel ground stake (not shown) to effectively ground nominally the entire landfill gas vent flare 10, including flarehead 15. One skilled in the art will recognize that such grounding, while providing important safety benefits, is necessary to enable proper operation of spark plug 18.

Thus connected, the ignitor supplies a continuous series of high voltage impulses to the spark plug which in turn, generates a series of sparks in the flarehead at predetermined intervals to ignite the gas flowing thereto. Such continuous spark generation serves to effectively ignite the gas and subsequently re-ignite it in the event the flame is extinguished due to adverse weather conditions, variations in gas flow rate, or varying percentages of constituent gases in the landfill gas. Moreover, the interval between sparks is preferably close enough to maintain a substantially continuous flame in the flarehead by effectively re-igniting the flame before it has a chance to be extinguished as a result of one or more of the above described conditions or variations. Thus, the interval may conveniently be between approximately 1 and 2 seconds, or preferably 1.5 seconds.

Accordingly, an important advantage of this continuous spark generation is that the aforementioned re-ignition of the gas in the event the flame has been, or is about to be extinguished for some reason, is accomplished without the need for sophisticated and expensive flame status monitoring, such as typically provided with prior art electrical ignition systems, or conventional pilot light systems which require a separate supply of fuel such as propane to fuel the pilot light. Moreover, this advantage is provided without the need for fine tuning the flare to compensate for the aforementioned variations in gas flow rate or percentages in constituent gases, since even in the event of conditions which would under normal conditions be insufficient to provide a self-sustaining flame, the continuous sparking of the present invention would re-ignite the gas with sufficient frequency as to effectively create a continuous flame.

A further advantage of this invention, is that the battery of the ignitor can supply enough energy to operate the spark plug continuously for approximately two weeks without recharge from the solar collector 36. Thus, the system is unaffected by relatively long periods of overcast weather.

Figure 4:
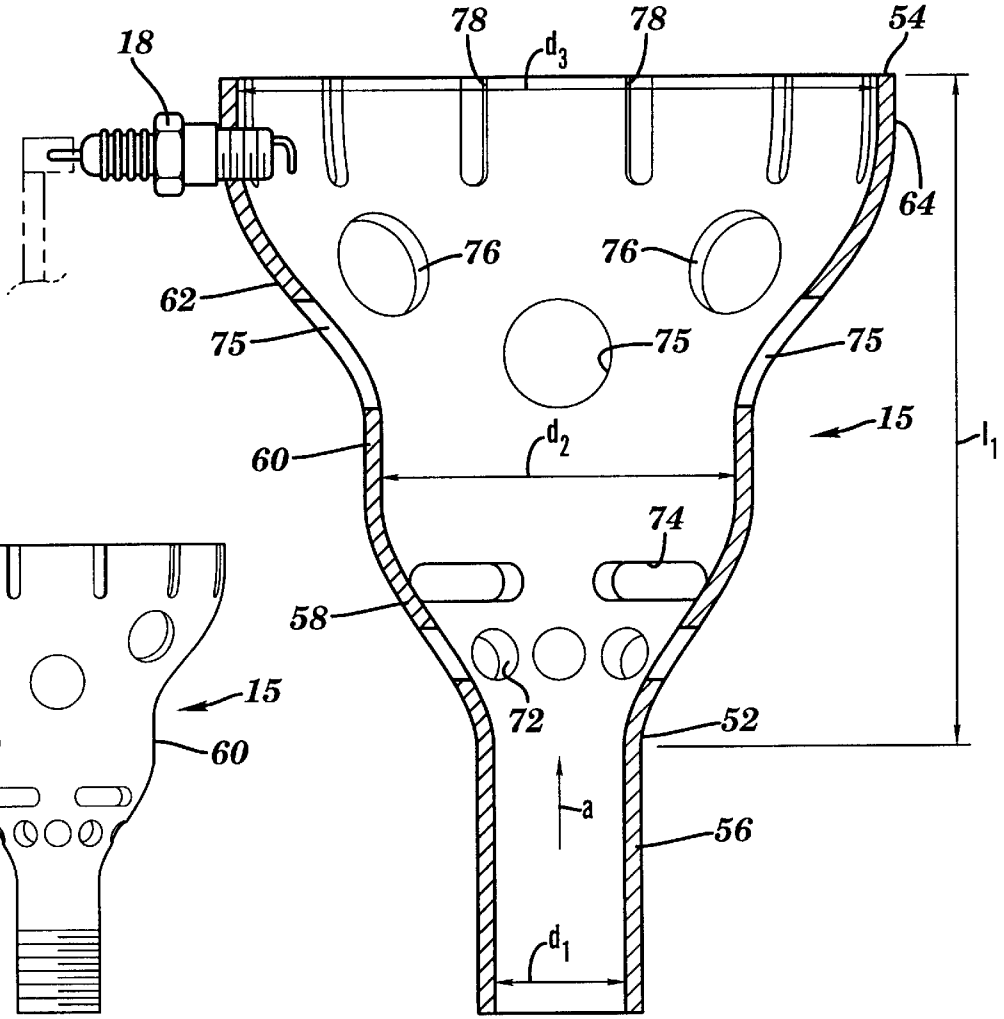
FIG. 4 is a cross-sectional view of the flarehead taken along 4—4 of FIG. 2.
Figure 2:
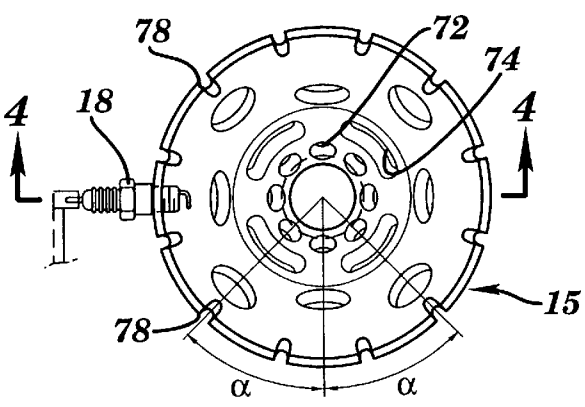
FIG. 2 is a plan view of the flarehead of the landfill gas vent flare of FIG. 1.
Figure 3:
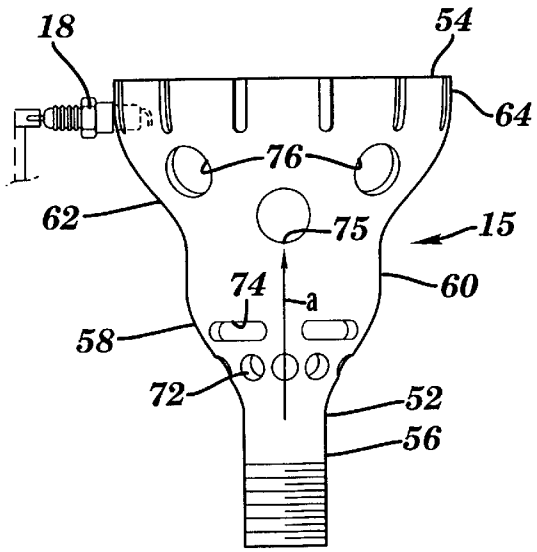
FIG. 3 is an elevational view of the flarehead of FIG. 2.

Referring now to FIGS. 2–5, as mentioned hereinabove, flarehead 15 generally comprises a modified frusto-conical or bell shaped structure, wherein the landfill gas flows in the downstream or gas flow direction a (FIG. 4) from apex end 52 to base 54 thereof. Referring specifically to FIGS. 3 & 4, in a preferred embodiment, the flarehead includes a cylindrical neck 56, having a predetermined inner diameter d1 (FIG. 4), which threadably, or otherwise, fastens to flame arrestor 32 (FIG. 1) as discussed hereinabove. The neck fairs, at apex 52, into a first frusto-conical portion 58, which, in turn, fairs into an intermediate cylindrical portion 60. Portion 60 has a predetermined diameter d2 (FIG. 4) which is greater than d1, extends for a predetermined distance in direction a, then fairs into second frusto-conical portion 62. Second frusto-conical portion 62, in turn, fairs into cylindrical end portion 64 which has a predetermined diameter d3 (FIG. 4) greater than d2. End portion 62 extends for a predetermined distance in direction a, and terminates at base 54.

Overall dimensions of flarehead 15 are not critical, and one skilled in the art will recognize that specific dimensions of the general structure described herein may be determined with regard to the intended application, including expected volume and flow rate of the landfill gas and size of flame desired. However, in a preferred embodiment, the ratio of the diameters to one another, namely, d1:d2:d3 is approximately 1.5:4:10. The ratio of overall length of flarehead 15 from apex 52 to base 54, as indicated by l1 in FIG. 4 to d3 (l1:d3) is preferably within the range of 0.8:1 to 1.5:1.

As mentioned hereinabove, air inlets are disposed about the flarehead to permit air to mix with the landfill gas and thus facilitate combustion thereof.

Referring now to FIGS. 2–4, the air inlets include a plurality of apertures 72 circumferentially spaced about first frusto-conical portion 58, proximate apex end 52. Additional inlets, comprising a plurality of elongated slots 74, are also spaced circumferentially about first frusto-conical portion 58, at a predetermined distance downstream of said apertures. As shown, each of the elongated slots is oriented so that the longitudinal dimension thereof is disposed in the circumferential direction of the flarehead, or transverse to flow direction a.

Air inlets further include a set of circumferentially spaced first orifices 75, (first set) and a set of similarly spaced second orifices 76, (second set), both sets being substantially disposed on second frusto-conical portion 62. First and second orifices 75 & 76, respectively, have preferably substantially similar, predetermined diameters which are greater than that of apertures 72. The second set of orifices 76 is disposed downstream of the first set of orifices 75. Moreover, the first set is offset relative to the second set wherein each orifice 75 & 76 is disposed at a different radial position along the periphery of the flarehead. Further, in a preferred embodiment as shown, the aforementioned offset is such that each first orifice 75 is disposed equidistantly from the two nearest second orifices 76, and vice-versa, to evenly stagger the orifices such that orifices 75 and 76 are alternately disposed at a constant radial intervals, as indicated by $\alpha$ in FIG. 2, about the circumference of the flarehead.

As shown in FIGS. 2–5, a plurality of elongated slits 78 are spaced at constant radial intervals about the circumference of cylindrical end portion 64 and extend in an upstream direction a predetermined distance from base 54. As also shown, spark initiator 18 preferably comprises a conventional spark plug which is threadably engaged to the flarehead to provide ignition sparks therein. As mentioned hereinabove, the flarehead is fabricated from electrically conductive material, preferably black iron, and is grounded to permit proper operation of the spark plug.

Figure 5:
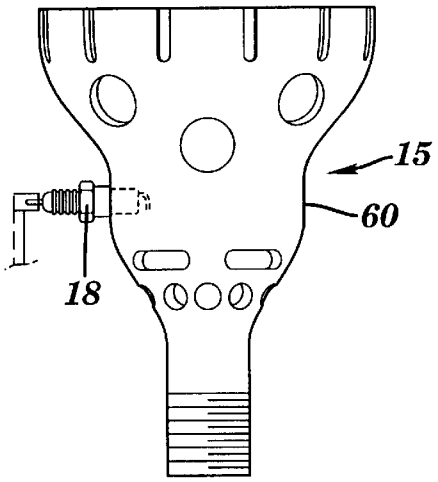
FIG. 5 is a view similar to that of FIG. 3, of an alternate embodiment of the flarehead.

As shown in FIGS. 2–4, the spark plug is disposed along cylindrical end portion 64 of the flarehead to ignite gas flows of relatively high volume and/or velocity. Alternatively, the spark plug may be disposed at a position further upstream, such as indicated in FIG. 5, to ignite gas flows of relatively low volume and/or velocity. As shown, the alternate position of the spark plug is preferably along intermediate cylindrical portion 60.

The construction of the subject invention thus provides several important benefits. Particularly, the air inlets, in combination with the overall geometry of the flarehead as shown and described herein, in and of themselves, help ensure adequate mixing of the landfill gas with ambient air, to ensure that the landfill gas burns in a continuous, self-sustaining manner, even in varying weather conditions. Moreover, as discussed hereinabove, the aforementioned continuous ignition also serves to provide a continuous, self-sustaining flame under a wide variety of conditions. Thus, the combination of these features, along with the aforementioned ability to place the spark plug optimally for given gas flow parameters, serve to provide an inexpensive and reliable gas vent flare.

A preferred embodiment of the invention having been fully described, the following is a description of the operation thereof.

Once the subject invention has been installed as set forth hereinabove, a user need simply mount spark plug 18 in one of the aforementioned spark plug locations, depending on the intended volume and/or velocity of gas flow. Valve 18 is then opened to permit the landfill gas to flow through conduit 14 and switch 46 is actuated to ignite the gas in flarehead 15. Once ignited, the user may modulate the valve 28 to optimize the size of the flame relative to the spark plug position. Once the valve is so adjusted, no further action is necessary by the user, other than routine maintenance such as cleaning and/or replacing flame arrestor pads 34 and spark plug 18.

The foregoing description is intended primarily for purposes of illustration. Although the invention has been shown and described with respect to an exemplary embodiment thereof, it should be understood by those skilled in the art that the foregoing and various other changes, omissions, and additions in the form and detail thereof may be made therein without departing from the spirit and scope of the invention.

Having thus described the invention, what is claimed is: We claim:

1. A landfill gas vent flare, comprising:

a flarehead adapted for communication with a landfill gas vent wherein landfill gas is permitted to flow in a downstream direction from the landfill gas vent to said flarehead; and at least one spark initiator disposed on said flarehead and adapted to generate a continuous series of sparks in said flarehead wherein the landfill gas flowing in said flarehead is ignited and continuously burned;

wherein said flarehead is adapted to mix air with the landfill gas to facilitate combustion of the landfill gas;

wherein said flarehead comprises at least one inlet to permit air to enter said flarehead and mix with the landfill gas;

wherein said flarehead is generally frusto-conical and the landfill gas flows downstream in said flarehead from an apex end to a base of said flarehead;

wherein said at least one inlet further comprises a plurality of apertures disposed in spaced relation about a circumference of said flarehead proximate said apex end;

wherein said at least one inlet further comprises a plurality of elongated slots disposed in circumferentially spaced relation about said flarehead at a position downstream of said apertures, each of said elongated slots having a longitudinal dimension which extends in a circumferential direction relative to said flarehead;

wherein said at least one inlet further comprises a first set and a second set of circumferentially spaced orifices, said first set being disposed downstream of said elongated slots, said second set being disposed downstream of said first set, and said first set being offset relative to said second set wherein each orifice of said first set and said second set is disposed at a discrete radial position along the periphery of said flarehead.

2. A landfill gas vent flare according to claim 1, wherein said at least one inlet further comprises a plurality of elongated slots disposed in spaced relation about the periphery of said base, each of said slots extending a predetermined distance upstream from said base.

3. A flarehead for a landfill gas vent flare adapted to permit landfill gas to flow in said flarehead in a downstream direction from an apex end to a base of said flarehead, comprising:

a first frusto-conical portion depending from said apex end, which fairs, in the downstream direction, to form a relatively smooth transition into an intermediate cylindrical portion; said intermediate cylindrical portion extending a predetermined distance in said downstream direction and fairing to form a relatively smooth transition into a second frusto-conical portion; said second frusto-conical portion in turn fairing to form a relatively smooth transition into a cylindrical end portion which terminates at said base.

4. A flarehead for a landfill gas vent flare according to claim 3, wherein said apex end is an annular orifice having a predetermined first diameter, said intermediate cylindrical portion having a predetermined second diameter which is greater than said first diameter, and said cylindrical end portion having a predetermined third diameter which is greater than said second diameter.

5. A flarehead for a landfill gas vent flare according to claim 4, wherein a ratio of said first diameter to said second diameter to said third diameter is approximately 1.5:4:10.

6. A flarehead for a landfill gas vent flare according to claim 5, wherein an overall length of said flarehead is defined as distance in the downstream direction from said apex end to said base, and a ratio of said overall length to said third diameter is preferably within the range of 0.8:1 to 1.5:1.

7. A flarehead for a landfill gas vent flare according to claim 4, further comprising a plurality of inlets disposed about said flarehead to permit ambient air to enter said flarehead and mix with the landfill gas.

8. A flarehead for a landfill gas vent flare according to claim 7, wherein said inlets further comprise a plurality of apertures disposed in circumferentially spaced relation about said first frusto-conical portion.

9. A flarehead for a landfill gas vent flare according to claim 8, wherein said inlets further comprise a plurality of elongated slots disposed in circumferentially spaced relation about said first frusto-conical portion at a predetermined distance downstream of said apertures, each of said elongated slots having a longitudinal dimension which extends in a circumferential direction relative to said flarehead.

10. A flarehead for a landfill gas vent flare in said flarehead in a downstream direction from an apex end to a base of said flarehead, comprising:

a first frusto-conical portion depending from said apex end, which fairs, in the downstream direction, into an intermediate cylindrical portion;

said intermediate cylindrical portion extending a predetermined distance in said downstream direction and fairing into a second frusto-conical portion;

said second frusto-conical portion in turn fairing into a cylindrical end portion which terminates at said base; and a plurality of inlets disposed about said flarehead to permit ambient air to enter said flarehead and mix with the landfill gas;

wherein said apex end is an annular orifice having a predetermined first diameter, said intermediate cylindrical portion having a predetermined second diameter which is greater than said first diameter, and said cylindrical end portion having a predetermined third diameter which is greater than said second diameter;

wherein said inlets further comprise a plurality of apertures disposed in circumferentially spaced relation about said first frusto-conical portion;

wherein said inlets further comprise a plurality of elongated slots disposed in circumferentially spaced relation about said first frusto-conical portion at a predetermined distance downstream of said apertures, each of said elongated slots having a longitudinal dimension which extends in a circumferential direction relative to said flarehead;

wherein said inlets further comprise a first set and a second set of circumferentially spaced orifices, both said first set and said second set being substantially disposed on said second frusto-conical portion, said second set being disposed downstream of said first set, and said first set being offset relative to said second set wherein each orifice of said first set and said second set is disposed at a discrete radial position along the periphery of said flarehead.

11. A flarehead for a landfill gas vent flare according to claim 10, wherein said inlets further comprise a plurality of elongated slits disposed in spaced relation about the periphery of said cylindrical end portion, each of said slits extending a predetermined distance in the upstream direction from said base.

12. A landfill gas burning assembly, comprising:

a landfill having a plurality of pipes therein adapted to allow landfill gas within said landfill to flow into said pipes; and a flarehead for a landfill gas vent flare in fluid flow relationship with said pipes and adapted to permit a portion of said landfill gas to flow in a downstream direction in said flarehead, comprising:

a first frusto-conical portion wherein said portion of said landfill gas flows downstream through said first frusto-conical portion from an apex end to a terminal end of said first frusto-conical portion;

a plurality of apertures disposed in circumferentially spaced relation about said first frusto-conical portion;

a plurality of elongated slots disposed in circumferentially spaced relation about said first frusto-conical portion at a predetermined distance downstream of said apertures, each of said elongated slots having a longitudinal dimension which extends in a circumferential direction relative to said flarehead; wherein said apertures and elongated slots are adapted to permit ambient air to enter said flarehead and mix with said portion of the landfill gas to facilitate combustion of said portion of the landfill gas.

13. The landfill gas burning assembly of claim 12, wherein said first frusto-conical portion fairs, in the downstream direction, into an intermediate cylindrical portion; and said intermediate cylindrical portion extends a predetermined distance in said downstream direction.

14. A flarehead for a landfill gas vent flare adapted to permit a portion of said landfill gas to flow in a downstream direction in said flarehead, comprising:

a first frusto-conical portion wherein said portion of said landfill gas flows downstream through said first frusto-conical portion from an apex end to a terminal end of said first frusto-conical portion;

a plurality of apertures disposed in circumferentially spaced relation about said first frusto-conical portion;

a plurality of elongated slots disposed in circumferentially spaced relation about said first frusto-conical portion at a predetermined distance downstream of said apertures, each of said elongated slots having a longitudinal dimension which extends in a circumferential direction relative to said flarehead;

wherein said apertures and elongated slots are adapted to permit ambient air to enter said flarehead and mix with said portion of the landfill gas to facilitate combustion of said portion of the landfill gas;

wherein said first frusto-conical portion fairs, in the downstream direction, into an intermediate cylindrical portion;

wherein said intermediate cylindrical portion extends a predetermined distance in said downstream direction;

wherein said intermediate cylindrical portion fairs, in the downstream direction, into a second frusto-conical portion;

said second frusto-conical portion having a first set and a second set of circumferentially spaced orifices disposed substantially on said second frusto-conical portion, being adapted to permit ambient air to enter said flarehead and mix with said portion of the landfill gas to facilitate combustion of said portion of the landfill gas;

said second set being disposed downstream of said first set; and said first set being offset relative to said second set wherein each orifice of said first set and said second set is disposed at a discrete radial position along the periphery of said flarehead.

15. The flarehead of claim 14, wherein said second frusto-conical portion fairs into a cylindrical end portion which terminates at a base of said flarehead;

a plurality of elongated slits are disposed in spaced relation about the periphery of said cylindrical end portion; and each of said slits extend a predetermined distance in the upstream direction from said base.

16. The flarehead of claim 15, wherein said apex end is an annular orifice having a predetermined first diameter;

said intermediate cylindrical portion has a predetermined second diameter which is greater than said first diameter; and said cylindrical end portion has a predetermined third diameter which is greater than said second diameter.

* * * * *